US005924254A

United States Patent [19]

Franklin et al.

[11] Patent Number: 5,924,254

[45] **Date of Patent: *Jul. 20, 1999**

[54] MODULAR PRECAST WALL SYSTEM

[75] Inventors: Howard M. Franklin; Erik Garfinkel, both of Palo Alto, Calif.

[73] Assignee: Megawall Corporation, Palo Alto, Calif.

[ * ] Notice: This patent is subject to a terminal disclaimer.

[21] Appl. No.: 08/872,444

[22] Filed: Jun. 10, 1997

Related U.S. Application Data

[63] Continuation of application No. 08/490,466, Jun. 14, 1995, Pat. No. 5,678,373, which is a continuation-in-part of application No. 08/335,059, Nov. 7, 1994, abandoned.

[51] Int. Cl.[6] ..... E04B 2/86

[52] U.S. Cl. ..... 52/439; 52/223.7; 52/442

[58] Field of Search ..... 52/293.2, 295, 52/439, 503, 504, 223.7, 566, 567, 592.6, 606, 607, 506.05

[56] References Cited

U.S. PATENT DOCUMENTS

| | | | |
|---|---|---|---|
| 1,412,113 | 4/1922 | Hermoye et al. | 52/606 |
| 1,704,255 | 3/1929 | Lewis | 52/295 |
| 1,783,383 | 12/1930 | Montriee | 52/223.7 |
| 3,106,751 | 10/1963 | Fish | 52/506.05 |
| 3,286,418 | 11/1966 | Radford | 52/606 |
| 3,378,969 | 4/1968 | Larger | 52/223.7 |
| 3,416,272 | 12/1968 | Gue | 52/606 |
| 3,435,567 | 4/1969 | Tyson | 52/503 |
| 3,950,902 | 4/1976 | Stout | 52/295 |
| 4,726,567 | 2/1988 | Greenberg | 52/293.2 |
| 4,787,189 | 11/1988 | Haug et al. | 52/606 |
| 5,138,808 | 8/1992 | Bengtson et al. | 52/295 |

*Primary Examiner*—Michael Safavi
*Attorney, Agent, or Firm*—Bradley T. Sako; Raymond E. Roberts; Michael J. Hughes

[57] ABSTRACT

A modular construction system (10), the preferred embodiment of which is directed toward the construction of structural walls (26). The construction system (10) employs precast wall units (12) and a variety of spacer/tensioning, spacer, tensioning, and extension assemblies (14, 16, 18, and 20). The wall units (12) contain a plurality of cavities (44) and are made of concrete with side walls (36) reinforced with prestressed tension wires (48). In the process of constructing a wall (26), the wall units (12) are stacked one upon the other onto threaded wall bars (24) that extend upwardly from a foundation (22). The spacer/tensioning assembly (14) and the spacer assembly (16) provide alignment during the stacking process and also create mortar joints (52). The spacer/tensioning assembly (14) and the tensioning assembly (18) are utilized in conjunction with the wall bars (24) to tension the wall units (12) onto lower wall units (12) and the foundation (22). When stacked, the internal structure of the wall units (12) creates vertically and horizontally extending passages (85 and 86) into which grout (84) is poured to create a monolithic wall (26).

19 Claims, 7 Drawing Sheets

MODULAR PRECAST WALL SYSTEM

This is a continuation of application Ser. No. 08/490,466 filed on Jun. 14, 1995 by Howard M. Franklin and Erik Garfinkel, which on Oct. 21, 1997 issued as U.S. Pat. No. 5,678,373 and which was in turn a continuation-in-part of now abandoned application Ser. No. 08/335,059 filed on Nov. 7, 1994 by the same inventors. Both of these parent applications are hereby incorporated by reference in their entirety.

TECHNICAL FIELD

The present invention relates generally to the field of construction, and more particularly to a construction system employing precast block units for the construction of walls and other structures in which mortar joints are desired.

BACKGROUND ART

Shelter is a basic need, mid human ingenuity has arrived at numerous and sophisticated methods and materials to meet this need. Among the many methods include those employing precast concrete units that are assembled to create a building or other structure. These methods encompass construction systems incorporating a wide range of precast unit designs that vary from the simple to the very complex. The most elementary precast unit designs are those used in basic, concrete masonry. While concrete masonry units (CMU's) may be designed for a variety of applications, they can result in structures that are structurally inferior to those created with larger, reinforced concrete units. Smaller CMU's can crack and chip as well. Construction with small CMU's also requires a specialized labor force. As a result, building methods utilizing CMU's can create high labor costs, and it can be difficult to find a qualified work crew.

More sophisticated construction systems use concrete columns, beams, and foundation members to create a superstructure. A beam and column joining assembly is set forth in U.S. Pat. No. 4,583,336, issued to Shelangoskie, et al. on Apr. 22, 1986. U.S. Pat. No. 5,103,613 issued to Satoru Kinoshita on Apr. 14, 1992 teaches foundation members interconnected by a binding member having mortises therein for receiving tenons on the bottom of a column. U.S. Pat. No. 4,124,963 issued to Tadayasu Higuchi on Nov. 14, 1978 sets forth a precast unit for providing a footing for a building. While the above patents describe a superstructure they provide no teachings on the construction of walls or the like. In addition, the precast units of the inventions provide little flexibility for increasing structural integrity of the larger structure.

Two U.S. Patents present precast units in which wall members are also employed. U.S. Pat. No. 4,328,651 issued to Manuel Gutierrez on May 11, 1982 shows a system having a number of precast units including footing boxes, grade beams, roof beams and a wall panel. The Gutierrez system sets forth an intricate system of interconnecting parts. The intricacies of the design limit the flexibility of the system, however. The beams and wall panels described therein would have to be formed to custom lengths and heights in order to meet the needs of differing structures. In addition, the wall panels lack flexibility for increasing structural strength. The second patent is U.S. Pat. No. 5,081,805 issued to M Omar A. Jazzar on Jan. 21, 1992. This patent teaches precast ) units of half-story height that include steel reinforcements. Tile Jazzar invention requires substantial lifting equipment, however, and is also limited in versatility. Furthermore, building designs departing from preformed dimensions require a second, expensive mold, or considerable custom work to arrive at the desired shape.

Authors David A. Sheppard and William R. Phillips illustrate unitary load-bearing or non-load-bearing precast panels in their book *Plant-Cast Precast & Prestressed Concrete—A Design Guide*, Third Edition, McGraw-Hill Inc., 1989, (see pages 311–13). The same book also illustrates the use of very large, precast, concrete "voided" bearing walls at page 340. The large bearing walls and precast panels, like those in the Gutierrez patent, must be custom formed and require large custom molds, a large site slab, and very large lifting equipment. In addition, the immense size of the walls makes them impractical for smaller construction projects.

Illustrated in a commercial brochure of American Con-Form Industries, Inc. (1993), is a modular construction system that employs stackable polystyrene units. Concrete is poured within the stacked units to create walls for different applications. The design of the units allows for the placement of reinforcing steel, but the units themselves are non-structural. Such a system suffers from a number of problems, including those inherent in having to pour large quantities of concrete, such as delays due to inclement weather conditions and the creation of clutter and debris at the work site. Moreover, strict engineering tolerances are difficult to obtain without skilled workers.

To the inventors' knowledge, no building system employing preformed building units has been developed that provides versatility in design, can accommodate a variety of reinforcement designs for great structural strength, requires relatively small lifting equipment, allows for the rapid construction of buildings, and that does not suffer from the limitations of poured concrete systems.

DISCLOSURE OF THE INVENTION

Accordingly, it is an object of the present invention to provide a construction system using precast units that can be used for the construction of a variety of building forms and designs.

It is another object of the invention to provide a construction system that can be used to rapidly construct buildings while achieving a very high quality of construction and great structural strength.

It is a further object to provide a construction system, using precast units, that can accommodate a wide range of reinforcement designs.

It is yet another object to provide a construction system using precast units, which system allows for the introduction of conventional mortar joints.

It is still a further object to provide a construction system that does not require a large amount of specialized erection equipment.

It is yet another object to provide a construction system that does not require a crew having specialized skills.

It is yet a further object to provide a construction system, using precast units, that includes alignment aids.

It is still another object to provide a construction system using precast units which can be easily cut to size.

It is still a further object of the present invention to provide a construction system that is cost effective for residential and light-commercial projects.

Briefly, the preferred embodiment of the present invention is a modular construction system employing precast wall units and a variety of spacer, tensioning, and extension assemblies for the construction of walls. The wall units contain cavities and are made of concrete and reinforced with prestressed steel wires. In the process of constructing a wall, the wall units are stacked onto threaded wall bars that extend upwardly from a foundation, the wall bars being inserted into the cavities of the wall units. The stacking is preformed with the aid of the spacer, tensioning, and extension assemblies. When stacked, the structure of the preferred wall units creates both vertically and horizontally extending passages within the resulting wall. Reinforcement rods or bundles of rods may be placed within both the vertical and horizontal passages. The tensioning assemblies utilize the vertically extending wall bars and the horizontally positioned reinforcement rods to tension the wall units onto lower wall units and onto the foundation. The extension assembly provides the capacity to extend the height of the wall bars and therefore the height to which the wall units may be stacked. Grout is poured within the vertical and horizontal passages of the stacked wall units to create a monolithic wall of great structural strength.

The spacer assemblies provide spaces between wall units for conventional mortar joints and also assist in the alignment of the wall units during their stacking. One variety of spacer assembly provides a tensioning capability in addition to providing mortar joint spaces and assisting in alignment. This spacer assembly includes a bracket which spans most of the width of the wall unit and which has an aperture for receiving a wall bar. The bracket also includes upwardly and downwardly extending pairs of vertical alignment fins which are inserted within the side walls of the wall units to give a precise stacking of the wall units. The bracket is tensioned down onto a wall unit by torquing a nut onto the threaded wall bar and bracket. The bracket is hidden from view by the mortar joint since it does not extend the fill width of the wall unit side walls.

A second variety of spacer assembly provides mortar joint spaces and assists in alignment of the wall units. This spacer assembly includes two bracket halves removably joined together with a bolt. Each bracket half has an upwardly and downwardly extending alignment fin. The side walls of wall units are inserted between the alignment fins of the mated bracket assembly to give precision stacking. After completion of the wall, the outer bracket half is removed and a simple patch of mortar is applied to fill the void. The inner bracket half is then hidden from view. This spacer assembly may be modified to include a wall brace fin which extends perpendicularly outward from the outer bracket half and wall. The wall brace fin includes an aperture to which external bracing may be connected to provide support for the wall during its construction where necessary.

An advantage of the present invention is that the construction system allows for a significantly more rapid and easy assemblage of walls and building forms than is possible by either conventional cast-in-place concrete or CMU construction methods.

Another advantage of the invention is that the construction system provides for the building of structures with significantly more uniform and accurate dimensions than is possible by either conventional cast-in-place concrete or CMU construction methods.

Yet another advantage is that the construction system allows for the introduction of more reinforcing material and therefore a greater structural strength than is possible with conventional CMU walls, with a strength that can approach that of a conventional cast-in-place concrete wall.

A further advantage is that the construction system allows a wall to be engineered and built as a conventional CMU wall and with the convenience thereof.

Yet a further advantage is that walls made with the construction system are significantly less water permeable than CMU construction methods.

Still another advantage of the invention is that the construction system allows for engineers to utilize the sidewalls of precast wall units as part of the overall structural wall thickness in their calculations for CMU-built walls.

Yet another advantage is that the precast units of the construction system may be stockpiled for immediate use.

A further advantage is that the precast units of the invention may be stocked in varying sizes for a wide range of applications.

Yet another advantage is that construction with the present invention may be carried out in inclement weather.

Still another advantage is that the construction system can be implemented by smaller work crews than are typically employed.

Yet a further advantage is that the construction system generates very little debris.

A still further advantage is that the construction system of the present invention does not require a superstructure.

These and other objects and advantages of the present invention will become clear to those skilled in the art in view of the description of the best presently known mode of carrying out the invention as described herein and as illustrated in the several figures of the drawings.

BEST MODE FOR CARRYING OUT THE INVENTION

Figure 1:
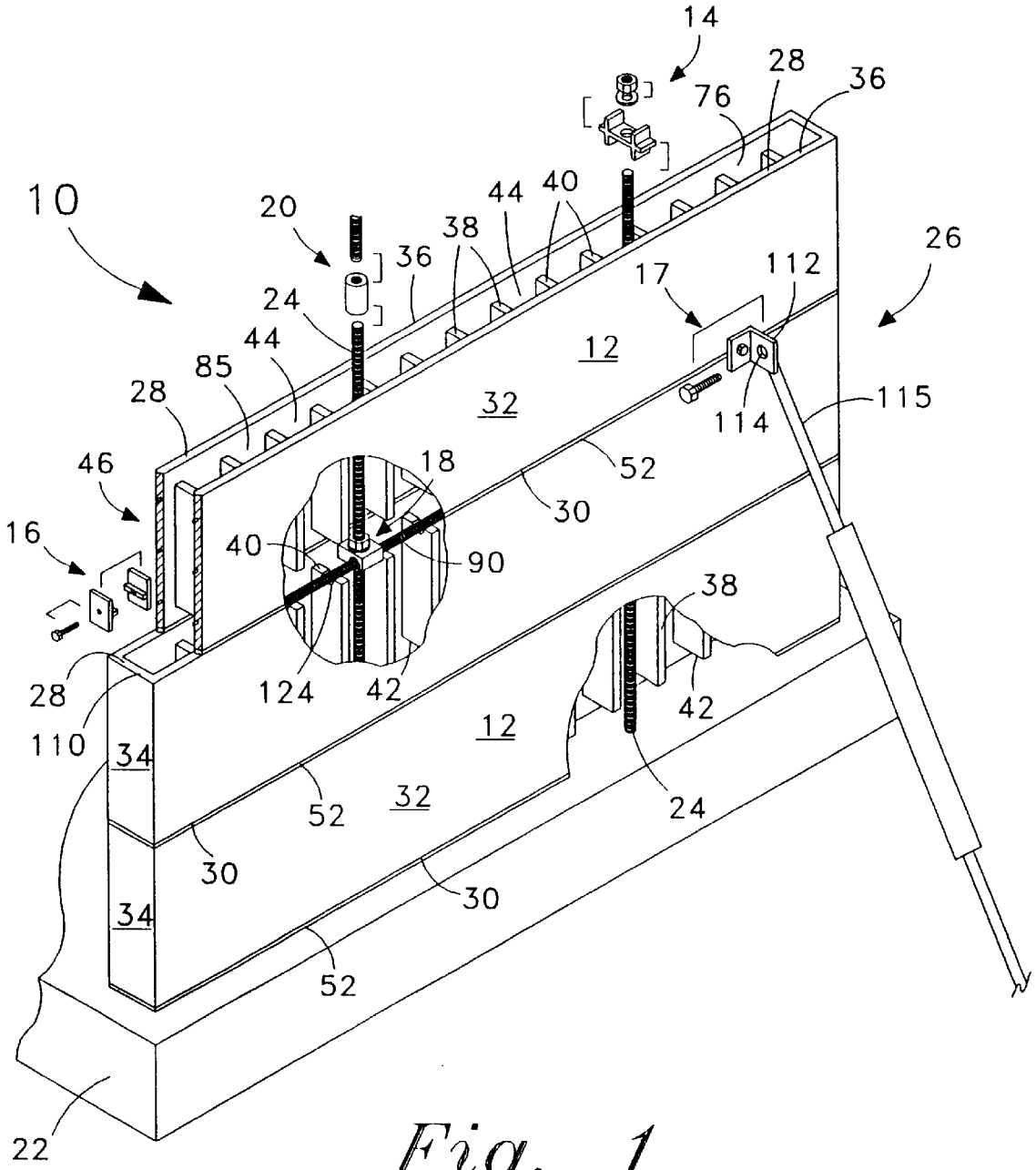
FIG. 1 is a fanciful isometric, cut-away view of the preferred embodiment of the present invention.

The preferred embodiment of the present invention is a modular construction system employing precast block units and providing for mortar joints between the block units. The construction system of the preferred embodiment is directed toward the creation of structural walls and is set forth in FIG. 1, where it is designated therein by the general reference character 10.

Referring to FIG. 1 of the drawings, the construction system 10 is shown to include a number of wall units 12, a combination spacer/tensioning assembly 14, a spacer assembly 16, a modified spacer assembly 17, a tensioning assembly 18, and a wall bar extension assembly 20. A base structure or foundation 22 provides a number of upwardly projecting wall bars 24 that are received by the wall units 12. As illustrated in FIG. 1, the wall units 12 of the preferred embodiment are designed to be stacked, one on top of the other, to create a vertical wall 26.

Figure 2:
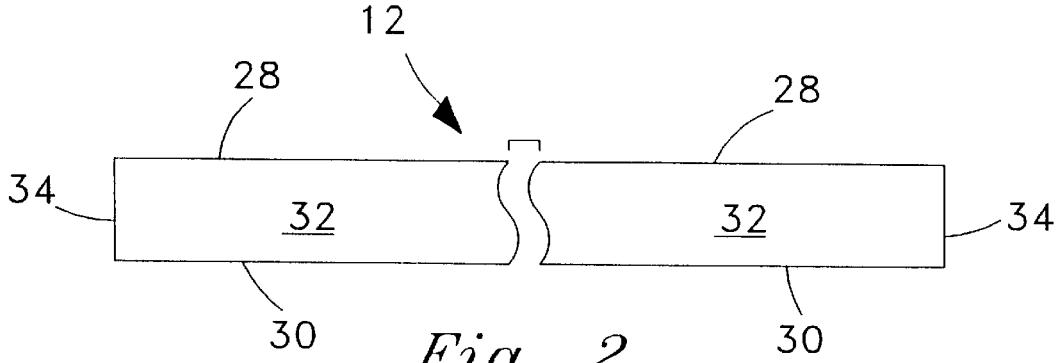
FIG. 2 is a side view of a wall unit of the preferred embodiment.
Figure 3:
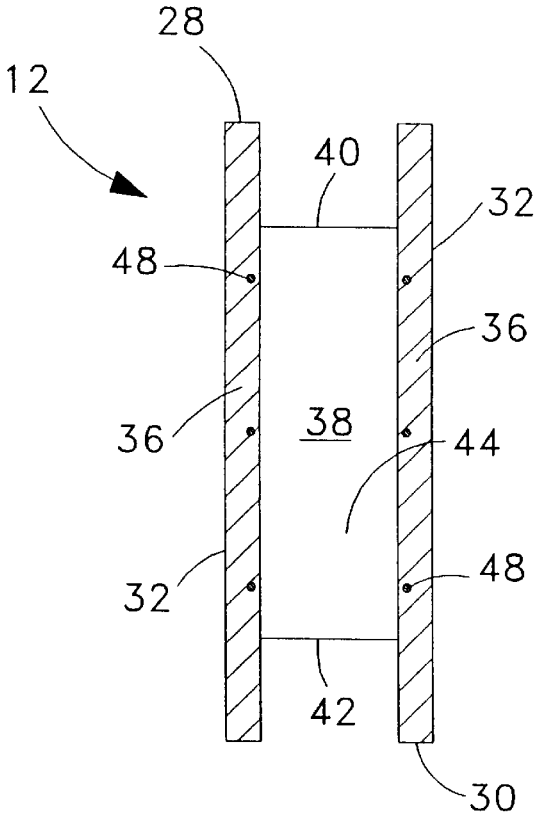
FIG. 3 is an end cross-sectional view through a cavity in a wall unit of the preferred embodiment.
Figure 4:
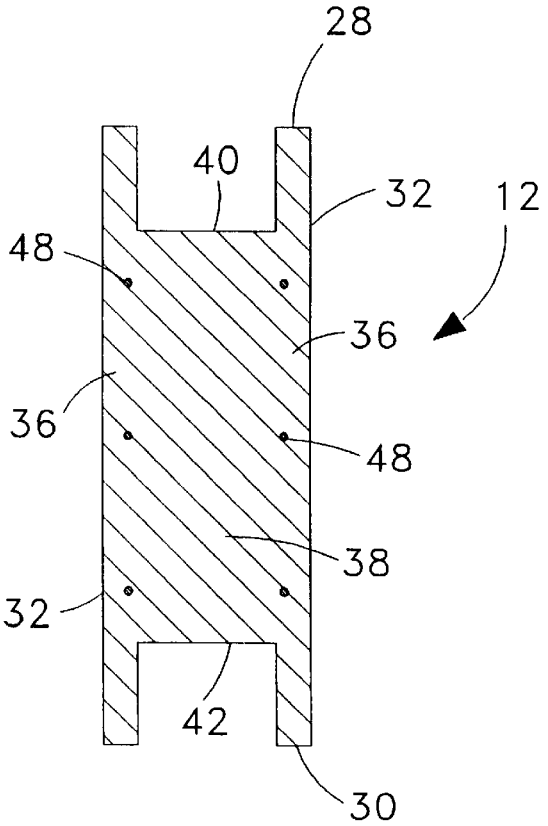
FIG. 4 is an end cross-sectional view through a cavity wall of a wall unit of the preferred embodiment.

The structure of the wall units 12 is detailed in FIGS. 2–4. As shown in the side elevational view of FIG. 2 and the end cross-sectional view of FIG. 3, the wall units 12 have a generally rectangular solid shape that includes a wall unit top surface 28, a wall unit bottom surface 30, two wall unit side surfaces 32, and two wall unit end surfaces 34. As indicated in the various figures, the wall unit side surfaces 32 are considerably longer than the wall unit end surfaces 34, typical wall unit 12 lengths and widths being on the order of 3.0 to 18.3 in (10 to 60 ft) and 20 to 30 cm (8 to 12 in) respectively. Typical wall unit 12 heights are on the order of 46 to 91 cm (18 to 36 in). The wall units 12 of the preferred embodiment 10 are precast, prestressed masonry forms composed of any of a variety of concrete mixes and additives depending on the strength required and the climate anticipated. In addition to various structural additives, the inclusion of color additives and waterproofing additives are contemplated as well. Furthermore, the wall units 12 may be provided with a variety of architectural finishes during the casting process (e.g., using a patterned form-liner, or adding aggregate). Commercially available insulation cores may be incorporated as well.

Each integrally molded wall unit 12 has two rectangular, parallel, opposing wall wilt side walls 36. The wall unit side walls 36 are joined by a number of cavity walls 38. As best illustrated in FIGS. 1 and 4, the cavity walls 38 are perpendicular to, and integral with, the wall unit side walls 36. In the preferred embodiment of the construction system 10, a cavity wall top surface 40 and a cavity wall bottom surface 42 are each recessed approximately 15 cm (6.0 in) from the wall unit top and bottom surfaces (28 and 30) for reasons as will be explained later herein. The wall unit side walls 36 and cavity walls 38 of the preferred wall unit 12 have thicknesses of approximately 3.8–4.4 cm (1.5–1.8 in) and 5.1 cm (2.0 in) respectively, with center to center distances of approximately 30.5 cm (12 in) between cavity walls 38. Although not indicated in the drawings, the various interior surfaces of the wall units 12 have slight tapers which are introduced during the formation of the wall units 12 to allow for the easy removal of the patterns used to mold the wall units 12. The inclusion of such tapers or "drafts" is well-known in the art.

The resulting structure comprised of wall unit side walls 36 and cavity walls 38 creates a number of vertically extending cavities 44 within the wall unit 12. As best shown in FIGS. 1 and 3, each cavity 44 extends for the height of the wall unit 12, opening onto both the wall unit top surface 28 and the wall unit bottom surface 30. The molded design and incorporation of cavities 44 into the wall unit 12 provides for both structural integrity and a substantial reduction in weight for the wall unit 12. This reduced weight pen-nits the rapid erection of walls 26 using lifting equipment of a relatively smaller size than would otherwise be possible.

Contained within each wall unit 12 of the construction system 10 of the preferred embodiment is a reinforcement structure 46. The reinforcement structure 46 is illustrated in the partial cutaway view of FIG. 1 and the cross-sectional views of FIGS. 3 and 4. The reinforcement structure 46 is comprised of three parallel tension wires 48 that are horizontally disposed within each wall unit side wall 36. The tension wires 48 are pre-tensioned and cast in place when the wall units 12 are formed. The tension wires 48 place the entire wall unit 12 under compression upon formation, which adds to the structural integrity of the wall unit 12 and reduces undesirable cracking and spalding, especially during transit and handling. The preferred material for the tension wires 48 is high tensile strength steel of approximately 5 mm (0.2 in) in diameter or otherwise meeting industry-accepted requirements. Despite the presence of the tension wires 48, and although the wall units 12 are precast at a discrete length, each wall unit 12 can be quickly and easily cut on-site to fit any length as required. Any number and type of tension wires 48 might be utilized according to the desired strength of the wall unit 12. Additional methods of imparting increased strength to the wall unit 12 include, among others, the casting in place of mild steel ("rebar"), and the post-tensioning of a cable or wire fitted into a plastic sleeve that is itself cast in place.

The preferred embodiment of the construction system 10 of the present invention contemplates the use of a variety of mortar spacing and wall tensioning methods and combinations thereof When wall bars 24 are employed, as shown in FIG. 1, the combination spacer/tensioning assembly 14 and/or wall bar extension assembly 20 may be incorporated to add structural strength, flexibility of design, and improve the speed and ease with which buildings can be constructed. The spacer/tensioning assembly 14 serves multiple functions, including providing a wall tensioning capability while also acting as a spacer to introduce and maintain spaces for mortar joints 52 between the wall unit top surface 28 of a lower wall unit 12 and the wall unit bottom surface 30 of a next higher wall unit 12. In addition to providing mortar spacing and adding structural integrity, the spacer/tensioning assembly 14 further allows for the wall units 12 to be securely attached to the foundation 22 without the need for additional bracing.

Figure 5:
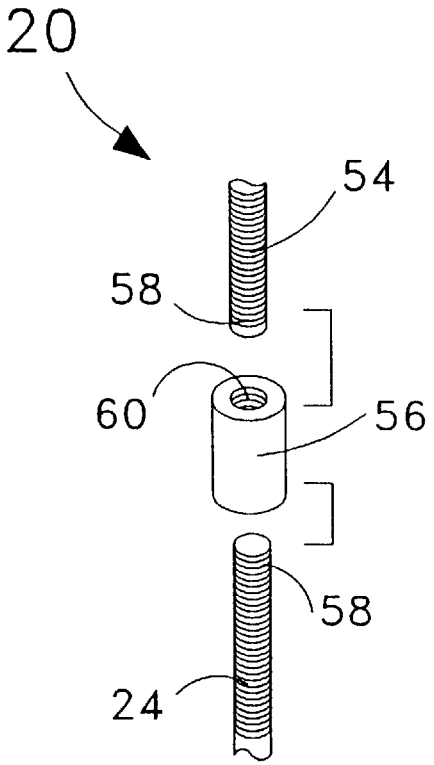
FIG. 5 is an exploded view of a wall bar extension assembly.
Figure 6:
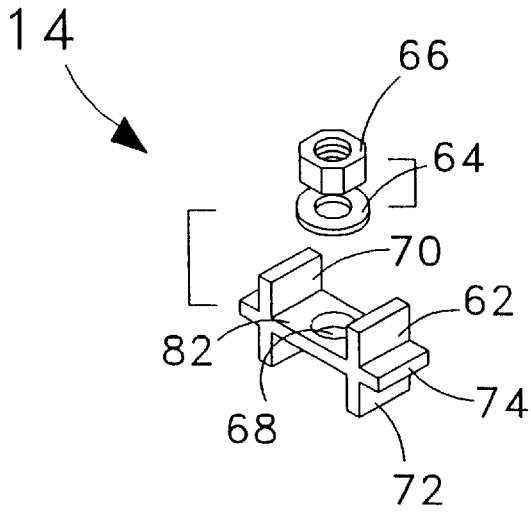
FIG. 6 is an exploded view of a combination spacer/tensioning assembly.
Figure 7:
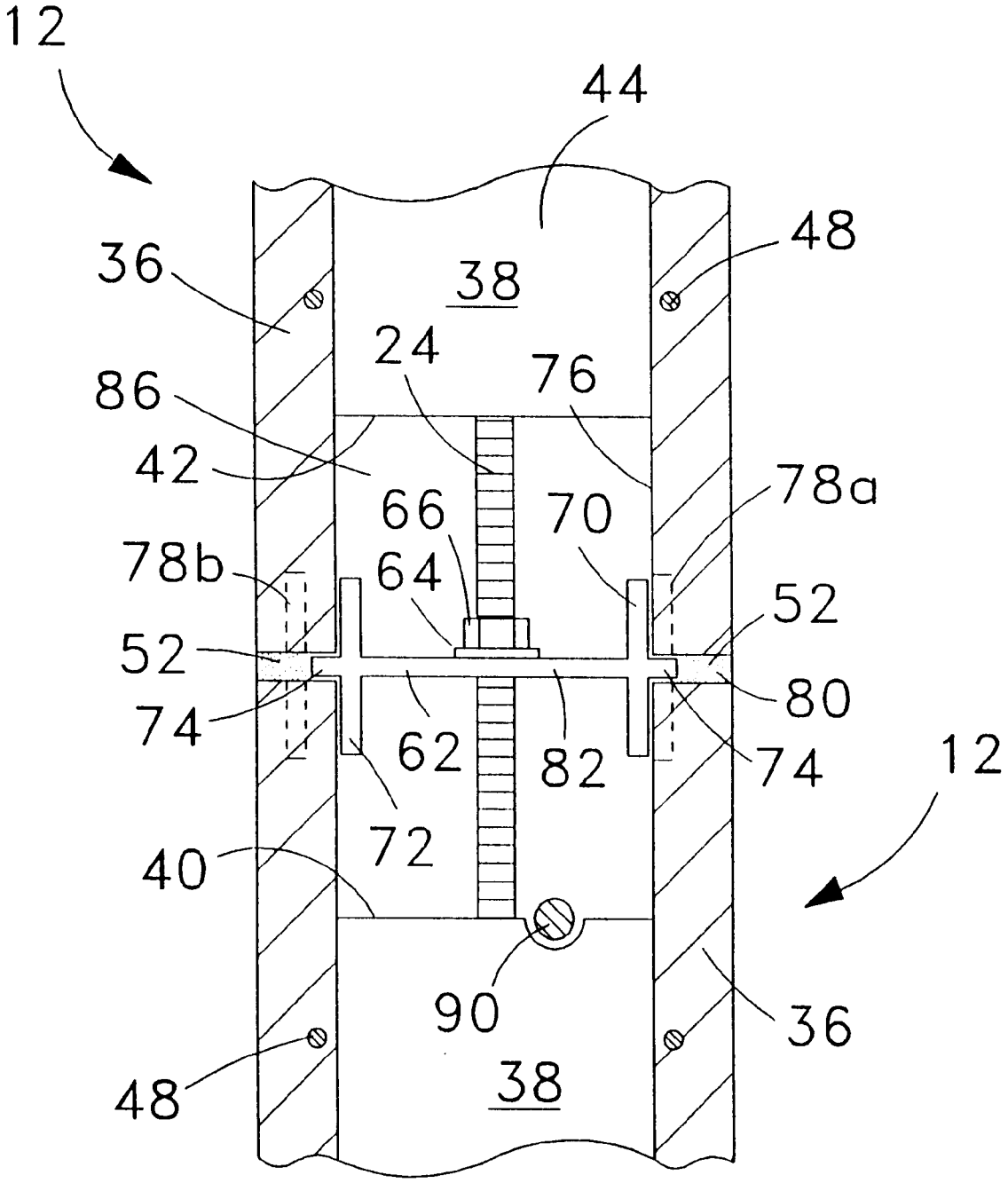
FIG. 7 is a cut-away, end cross-sectional view through the cavities of two stacked wall units of the preferred embodiment incorporating the combination spacer/tensioning assembly.

The wall bar extension assembly 20 and combination spacer/tensioning assembly 14 are set forth in detail in FIGS. 5–7. FIG. 5 shows an exploded view of the wall bar extension assembly 20 and an associated wall bar 24. The wall bar extension assembly 20 includes an extension bar 54 and a bar coupler 56. Both the wall bar 24 and the extension bar 54 are threaded, and each includes two bar ends 58. The bar coupler 56 includes a threaded coupler aperture 60 for simultaneously receiving the bar ends 58 of both the wall bar 24 and the extension bar 54. The wall bar extension assembly 20 provides, in essence, the capacity to vertically extend the wall bar 24. This aspect is advantageous in the event the wall units 12 must be stacked higher than the vertical height of the wall bars 24. By using the wall bar extension assembly 20, extension bars 54 may be added to as great a height as is necessary for the structure under construction.

A preferred embodiment of the spacer/tensioning assembly 14 is set forth in detail in FIGS. 6 and 7. As illustrated in the exploded view of FIG. 6, the spacer/tensioning assembly 14 of the construction system 10 includes a spacer/tensioning bracket 62, a tensioning washer 64, and a tensioning nut 66. The spacer/tensioning bracket 62 is integrally formed and includes a bar receiving aperture 68, two upper alignment fins 70, two lower alignment fins 72, and two spacer fins 74. Both pairs of upper and lower alignment fins (70 and 72) are present in parallel opposing fashion, with an upper alignment fin 70 and a lower alignment fin 72 being present in an identical vertical plane. Each spacer fin 74 projects horizontally outward from an upper and lower alignment fin (70 and 72) in a plane perpendicular to the aforementioned vertical plane. In the construction system 10 of the preferred embodiment (and in applications for which wall units 12 having a width of approximately 20 cm (8.0 in) are utilized), the spacer/tensioning bracket 62 will have an overall length of approximately 15 cm (6.0 in), with a width of approximately 5.1 cm (2.0 in). The preferred spacer fins 74, as will be explained below, have a thickness of approximately 0.95 cm (0.38 in).

Referring now to both FIG. 6 and the cross-sectional view of FIG. 7, the spacer/tensioning bracket 62 fits over the wall bar 24 with the wall bar 24 passing through the bar receiving aperture 68 and with the lower alignment fins 72 being inserted between the interior surfaces 76 of opposing wall unit side walls 36. The tensioning washer 64 and tensioning nut 66 are subsequently threaded onto the wall bar 24 and can be tightened such that the spacer/tensioning bracket 62 exerts a downward force on the wall unit top surface 28 to thereby tension the wall unit 12 onto the foundation 22 or a wall unit 12 directly below. When a second wall unit 12 is stacked on top of the first wall unit 12, the upper alignment fins 70 are likewise inserted between the interior surfaces 76 of opposing wall unit side walls 36 of the upper wall unit 12. The spacer/tensioning bracket 62 thus forces the wall unit side walls 36 of the two wall units 12 to be in vertical alignment. The clearances between the upper and lower alignment fins (70 and 72) and the inferior surfaces 76 of the wall unit side walls 36 are small so that precision stacking may be achieved. The spacer/tensioning assemblies 14 are typically incorporated at increments of 3.0 to 4.6 m (10 to 15 ft) along the length of a wall unit 12.

Also shown in FIG. 7, and indicated therein by dashed lines, are variations on the preferred embodiment in which notches 78*a* or 78*b* are incorporated into the wall unit side walls 36. Notch 78*a* is a recess in the interior surface 76 of the wall unit side wall 36, while notch 78*b* is a vertical hollow in the wall unit top or bottom surfaces (28 or 30). Either of the recessed or hollowed notches (78*a* or 78*b*) can be precast or field-cut and both allow for simultaneous vertical and horizontal alignment of the wall units 12. (The spacer/tensioning bracket 62 would of course require a lengthening of the distance between opposing pairs of upper and lower alignment fins (70 and 72) in order to accommodate these variations so that those alignment fins (70 and 72) may be mateably received by the notches (78*a* or 78*b*.) In addition, it is contemplated that a bracket similar to spacer/tensioning bracket 62 could be employed, wherein the upper and lower alignment fins (70 and 72) are omitted to give a bracket that is essentially a flat plate having only the bar receiving aperture 68 and that functions in a spacer capacity only. This "bare" bracket could be used in conjunction with wall units 12 having notches similar to hollowed notch 78*b*, and into which a separate alignment fixture (e.g., a short metal bar) is placed, or with wall units 12 that are precast to include mating vertical protrusions and hollows in the wall unit top and bottom surfaces (28 and 30), or in some other way specifically shaped to aid in alignment and stacking.

Continuing to refer to FIG. 7, the spacer fins 74 prevent the top and bottom surfaces (28 and 30) of stacked wall units 12 from making contact, thereby creating spaces for mortar joints 52. In practice, mortar 80 is applied during the stacking process, that is, an upper wall unit 12 is laid upon a fresh bed of mortar 80 covering die wall unit top surface 28 of a lower wall unit 12. Because the spacer fins 74 do not extend completely to the wall unit side surfaces 32, but rather are set back by approximately 2.5 cm (1.0 in), the spacer/tensioning bracket 62 is hidden from view by the mortar joint 52. For the first course of wall units 12 rising up from the foundation 22, standard construction shims (not shown) are inserted between the wall unit bottom surface 30 and the foundation 22 to insure that the resulting wall 26 is level and aligned. In addition, since a mortar joint 52 is also desired between the foundation 22 and the first course of wall units 12, a modified spacer/tensioning bracket 62 having no lower alignment fins 72 is employed at the base of the first course in order to provide spacing for the mortar joint 52.

While the spacer/tensioning bracket 62 as depicted in the drawings is shown with the intermediary portion 82 of the spacer/tensioning bracket 62 lying between opposing pairs of upper and lower alignment fins (70 and 72) as being planar and plate-like, it is contemplated that this intermediary portion 82 may be specifically designed to assist in the flow of grout over and around the spacer/tensioning bracket 52 and throughout the wall 26. Thus, this intermediary portion 82 may be preferably formed with a downwardly-curving or other hydraulically engineered shape.

For the construction of structures in which the Uniform Building Code (UBC) is controlling, the thickness of the spacer fins 74 will generally be 0.95 cm (0.38 in) or greater, because a mortar joint 52 of that thickness, under current UBC requirements, permits the thickness of the wall unit side walls 36 to be taken into account as part of the overall wall unit 12 thickness for purposes of structural engineering calculations. For walls employing CMU's, the genre in which the wall units 12 of the preferred embodiment of the present invention are technically categorized, in which mortar 80 is not used, or in which mortar 80 is present in a thickness of less than 0.64 cm (0.25 in), structural wall thickness calculations must be limited to using the width of the (grout-filled) cavities 44 only, as measured between the interior surfaces 76 of opposing wall unit side walls 36. Thus, the inclusion of a sufficiently thick mortar joint 52 allows wall units 12 of a smaller width to be used than would otherwise be possible in the construction of walls using CMU's, reducing both the weight of the wall units 12 and construction costs. Moreover, the presence of mortar joints 52 allows a wall 26 to be engineered and built as a conventional CMU wall. It is contemplated, however, that UBC requirements may be revised and modified, in part because of the introduction onto the market of the wall units 12 of the present invention, to make it possible to meet certain structural requirements with the use of an adhesive other than mortar 80. For example, an epoxy or similar glue might be permitted to be employed to make an adhesive, water-tight joint between the wall unit top mid bottom surfaces (28 and 30).

Figure 8:
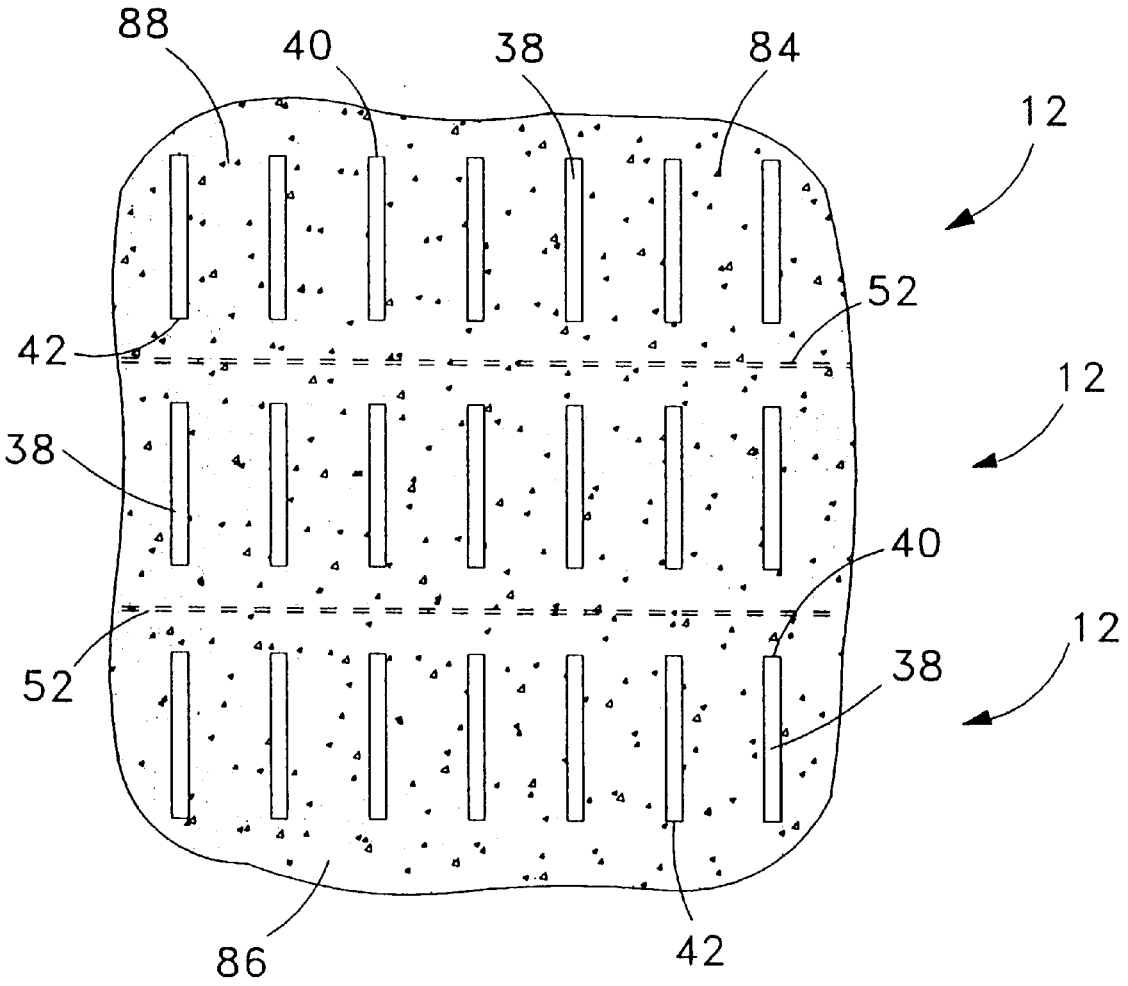
FIG. 8 is a fragmentary side view of a grout-filled wall with wall unit side walls removed.

As noted previously, and still referring to FIG. 7, in the preferred embodiment of the construction system 10, the cavity wall top and bottom surfaces (40 and 42) are each recessed from the wall unit top and bottom surfaces (28 and 30). Thus, when two wall units 12 are stacked one upon the other, in addition to a plurality of vertical passages 85 being formed, the cavity wall top surfaces 40 of the lower wall unit 12 and the cavity wall bottom surfaces 42 of the upper wall unit 12 combine together with interior surfaces 76 of opposing wall unit side walls 36 to create a horizontally disposed passage 86 that extends the length of the stacked wall units 12. Referring also to FIG. 8 now, the passage 86 permits grout 84 that is poured into the cavities 44 to flow between laterally adjacent cavities 44, thereby creating a wall 26 in which is contained a continuous cementitious skeleton 88. The passage 86 also allows for the placement of horizontal reinforcement rod or rebar 90 within the wall units 12. The cementitious skeleton 88, reinforced by rebar 90 (and wall bar 24), greatly increases the structural integrity of the resulting wall 24, although for some applications (and under certain building codes), grout 84 and/or reinforcement with rebar 90 may be unnecessary. (Although not shown, even greater reinforcement is possible by wrapping containment rings or ties around rebar 90 of more than one level of wall units 12.) It is also possible to create a passage similar to passage 86, and into which rebar 90 may likewise be placed, by recessing only the cavity wall top surfaces 40. However, the additional recessing of the cavity wall bottom surfaces 42 enables standard rigging equipment to be employed to grab hold and lift wall units 12 of any length without the need for special precast or field-installed lifting inserts. In the preferred wall units 12, all of the cavity wall bottom surfaces 42 are recessed so that if it is necessary to cut a wall unit 12 at any particular point, a cavity wall bottom surface 42 will always be present so that a hook of the rigging equipment may be positioned thereunder for lifting. The application of mortar 80 between the wall unit top and bottom surfaces (28 and 30), and the pouring of grout 84 into the cavities 44 and passages 86, provides a monolithic wall 26 of great structural strength.

While in FIG. 8 a continuous cementitious skeleton 88 is shown, it is also contemplated that for certain applications, in which less structural strength is required, grout 84 might not be poured throughout the entire wall 26. For these lower strength applications, sleeves or similar partitioning devices (not shown) might be employed to prevent the grout 84 from entering the horizontal passages 86, thereby creating single vertical grout voids (i.e., contained vertical passages 85) wherein discrete concrete pillars or columns would be formed upon the pouring of the grout 84. These voids could similarly be permitted to remain empty, with grout 84 poured in neighboring vertical and horizontal passages (85 and 86). This latter application is useful where, for example, plumbing fixtures need to be installed or maintained.

As indicated previously, in the construction system 10 of the preferred embodiment, the foundation 22 provides a number of vertically disposed reinforcing wall bars 24. Referring once again to FIG. 1, it is shown that the wall units 12 are stacked onto the foundation 22 with the wall bars 24 inserted through the cavities 44 within the wall units 12. While the incorporation of wall bars 24 provides for walls 26 of increased strength, it is understood that walls 26 can also be built that do not have wall bars 24 by simply stacking the wall units 12 and introducing a mortar joint 52 with a spacing device that does not utilize a wall bar 24. Spacer assembly 16 may be employed in this regard. Moreover, spacer assembly 16 can also be employed in conjunction with the combination spacer/tensioning assembly 14 and/or the tensioning assembly 18, as shown in FIG. 1.

Figure 9:
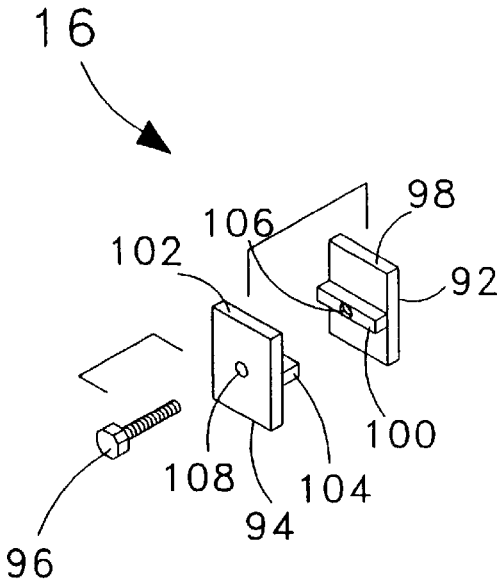
FIG. 9 is an exploded view of a spacer assembly.
Figure 10:
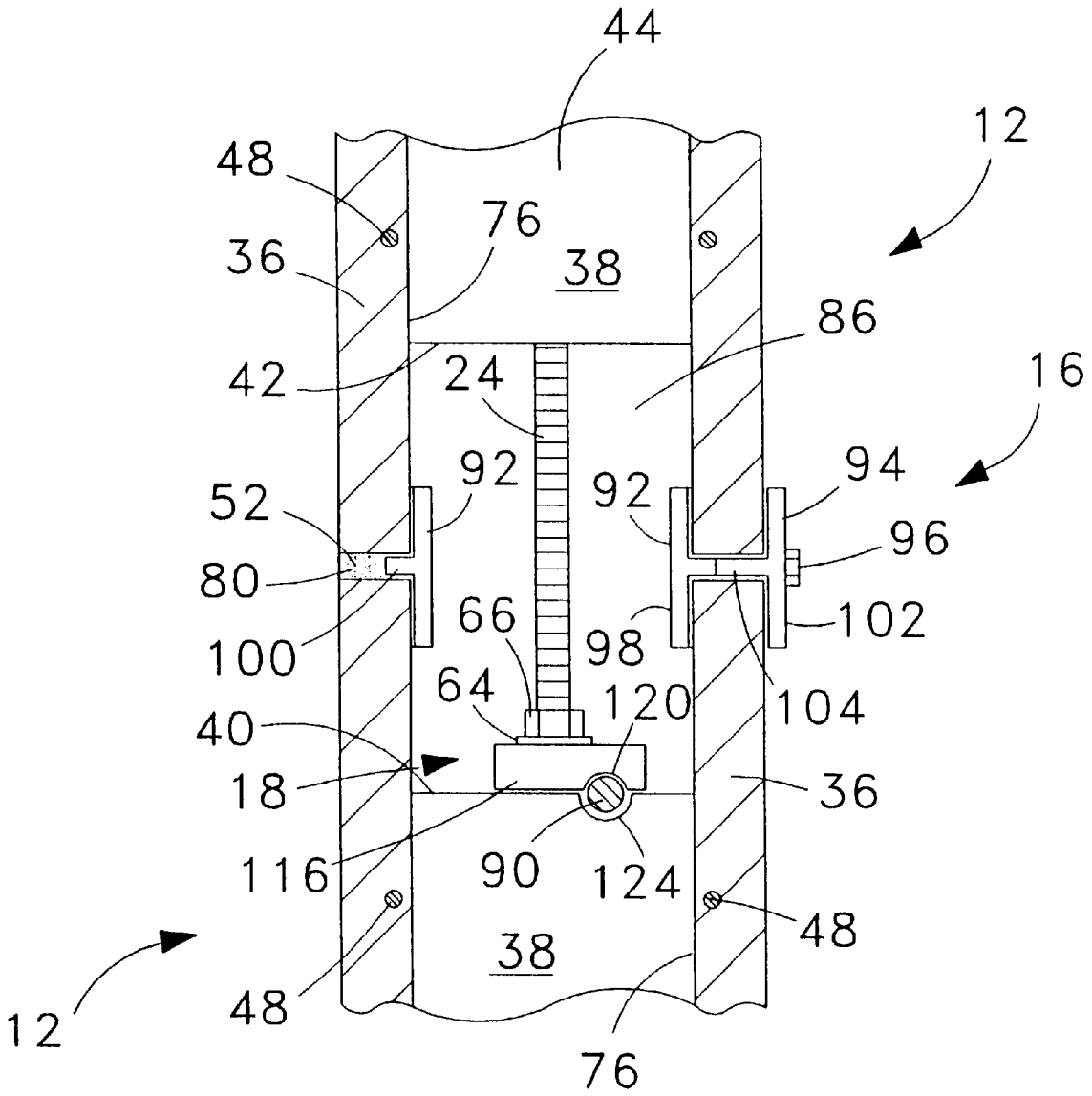
FIG. 10 is a cut-away, end cross-sectional view through the cavities of two stacked wall units of the preferred embodiment incorporating a spacer assembly and a tensioning assembly.

Referring now to the exploded view of FIG. 9, one preferred embodiment of the spacer assembly 16 is shown to include all inner bracket half 92, an outer bracket half 94, and a bracket bolt 96. The inner bracket half 92 includes inner bracket alignment fins 98 and an inner bracket spacer fin 100 that is perpendicular to the inner bracket alignment fins 98. The outer bracket half 94 similarly includes outer bracket alignment fins 102 and a perpendicular outer bracket spacer fin 104. The outer bracket spacer fin 104 is longer than the inner bracket spacer fin 100 (this is best seen in FIG. 10). The inner bracket spacer fin 100 is provided with a threaded, bolt receiving aperture 106, while the outer bracket spacer fin 104 has a non-threaded, bolt receiving aperture 108. Analogously to spacer/tensioning bracket 62, both sets of inner and outer bracket alignment fins (98 and 102) are present in parallel opposing fashion when the inner and outer bracket halves (92 and 94) are mated together with bracket bolt 96. The preferred inner and outer bracket spacer fins (100 and 104) have a thickness of approximately 0.95 cm (0.38 in) to allow for a mortar joint 52 of at least 0.64 cm (0.25 in) thickness.

Referring now to the cross-sectional view of FIG. 10, in which is shown both a complete and a partial spacer assembly 16, the inner and outer bracket halves (92 and 94) are assembled together with the bracket bolt 96 and then positioned over a wall unit top surface 28 so that the inner and outer bracket alignment fins (98 and 102) straddle the wall unit side wall 36, the inner bracket half 92 being on the cavity 44 side of the wall unit 12. When a second wall unit 12 is stacked on top of the first wall unit 12, the wall unit side wall 36 of the upper wall Unit 12 is likewise inserted into opposing inner and outer bracket alignment fins (98 and 102). The distance between opposing inner and outer bracket alignment fins (98 and 102) is just sufficient to allow insertion of the wall unit side walls 36, thus the wall unit side walls 36 of the two wall units 12 are forced into vertical alignment and precision stacking may be achieved. Once the wall units 12 have been stacked, mortared, and grouted, the bracket bolt 96 is removed together with the outer bracket half 94. The inner bracket half 92 is left in place (as shown at the left of the drawing) to maintain the desired spacing for the mortar joint 52. A simple patch of mortar 80 is applied to fill in the void in the mortar joint 52 remaining from removal of the outer bracket half 94. Thus, the inner bracket half 92 is hidden from view. Like the combination spacer/tensioning assembly 14, the spacer assemblies 16 (where used alone) are typically incorporated at increments of 4.6 m (10 to 15 ft) along the length of a wall unit 12. Notches similar to recessed and hollowed notches (78*a* and 78*b*) may also be utilized in conjunction with the spacer assembly 16, together with other automatic alignment methods as described previously for spacer/tensioning bracket 62.

Although the spacer assembly 16 does not have the wall tensioning capability of the spacer/tensioning assembly 14, since it is designed to interact with only one of the wall unit side walls 36 at a time, the spacer assembly 16 is more flexible in other regards. Specifically, the inner and outer bracket alignment fins (98 and 102) of the mated spacer assembly 16 are able to straddle both a wall unit side wall 36 and a wall unit end wall 110. Thus, the spacer assembly 16 can be used to align not only the wall unit side walls 34, but also the wall unit end walls 110, unlike the spacer/tensioning bracket 62.

Furthermore, as shown in FIG. 1, the outer bracket half 94 of the spacer assembly 16 may be modified to integrate a wall brace fin 112. In the modified spacer assembly, which is given the reference numeral 17 in the drawing, the wall brace fin 112 extends perpendicularly outward from the outer bracket half 94 and includes a wall brace fin aperture 114. The modified spacer assembly 17 may be used to assist in the bracing of a wall 26 during its construction when the height of the wall 26, or the prevailing wind conditions, are such that the use of external bracing is mandated to prevent the wall from leaning or falling over. External bracing 115, such as a rod or beam, may be conveniently attached to the wall brace fin 112 via either bolting or tying with a cable through the wall brace fin aperture 114. In addition, the wall brace fin 112 may be further employed to assist in the alignment of consecutive lengths of walls 26. The situation will often exist where it will be required that two or more walls 26 be placed end-to-end in order to construct a structure having a sufficiently long overall wall length. And even where it is possible to pre-cast wall units 12 of sufficient length for the particular application at hand, building code requirements may mandate that vertical "breaks" or joints be incorporated at specific distances along the length of a wall 26 to help maintain the integrity of the wall 26. In either event, the modified spacer assembly 17 having the wall brace fin 112 can be used to assist in plumbing adjacent wall 26 sections. As with the unmodified version of the spacer assembly 16, the outer bracket half 94 (which incorporates the wall brace fin 112) is removed after grouting of the wall and a simple patch of mortar 80 applied to fill the resulting void. The modified spacer assembly 17 may be placed anywhere along a horizontal mortar joint 52 to meet a wide range of job-specific requirements.

It is also understood that the above-described embodiment of the spacer assembly 16 is only one of many possible embodiments. Another prominent example would be a purely internal spacer assembly of unitary construction essentially identical to the spacer/tensioning bracket 62, but without the bar receiving aperture 68. Of course, the spacer/tensioning brackets 62 may be used as is, with the bar receiving aperture 68 simply being ignored. All of the various embodiments of the spacer/tensioning bracket 62 and the spacer assembly 16 may be made of steel, plastic, or other structural material.

As mentioned previously, the spacer assembly 16 may be used alone or in conjunction with the spacer/tensioning assembly 14. Where horizontal rebar 90 (and wall bar 24) is employed, the spacer assembly 16 and/or spacer/tensioning assembly 14 may also be used, as shown in FIG. 1, in conjunction with tensioning assembly 18. As illustrated in the exploded view of FIG. 11, the tensioning assembly 18 includes a rebar bracket 116, a tensioning washer 64, and a tensioning nut 66. The rebar bracket 116 includes a wall bar receiving aperture 118 and a rebar receiving notch 120 which traverses the width or length of the rebar bracket bottom surface 122.

Figure 11:
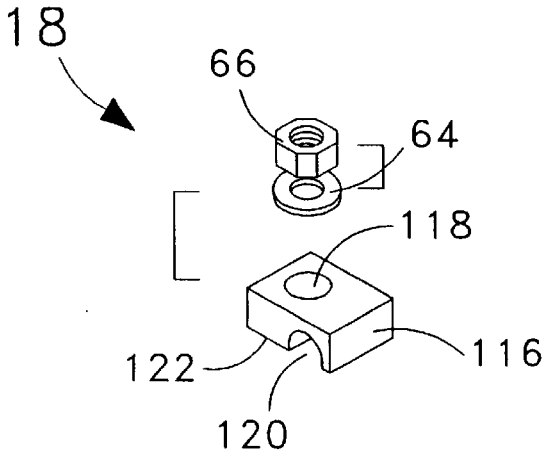
FIG. 11 is an exploded view of a tensioning assembly.

Referring to both FIG. 11 and the cross-sectional view of FIG. 10, the rebar bracket 116 fits over the wall bar 24 with the wall bar 24 passing through the wall bar receiving aperture 118 and the rebar receiving notch 120 fitting onto the horizontal rebar 90. As indicated previously, the horizontal rebar 90 lies within passage 86. In the construction system 10 of the preferred embodiment, rebar guide notches 124 are precast or field-cut into the cavity wall top surfaces 40 to assist in the positioning ("registering") of the rebar 90 and to further increase the structural integrity of the resulting wall 26. The tensioning washer 64 and tensioning nut 66 are subsequently threaded onto the wall bar 24 and are tightened such that the rebar bracket 116 exerts a downward force on the wall unit 12 via the registered horizontal rebar 90, thereby tensioning the wall unit 12 onto the foundation 22 or a wall unit 12 directly below. The ability to employ the various combinations of the different spacer and tensioning assemblies (14, 16, 17 and 18) gives the construction system 10 of the preferred embodiment great versatility in application.

While the above disclosure describes the use of the wall units 12 only in terms of vertical applications (i.e., the building of walls), the "wall" units 12 may just as easily be used in similar fashion for horizontal applications such as floors and decks (in which cases the wall unit side surfaces 32 would face upward and downward). Moreover, the nature of the wall units 12 is such that an individual wall unit 12 may be employed singularly to function as a beam. Applications include, among others, a beam for spanning an opening such as a large doorway, or a grade beam for a pier and grade-beam foundation. To use the wall unit 12 in the capacity of a beam, the wall unit 12 is conveniently placed upright oil a flat piece of wood or similar surface and concrete is poured within the cavities 44. Typical beam applications require a large amount of reinforcement, and the recessed nature of the cavity walls 38 permits a larger amount of reinforcing steel and concrete to be added than is possible with existing CMU's.

In addition to the preceding and above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to be interpreted as encompassing the entire spirit and scope of the invention.

Industrial Applicability

The modular precast construction block system 10 of the present invention is compatible with wall and foundation designs that would normally employ standard cast-in-place concrete walls. Implementation of the construction system 10 is simple compared to heretofore known methods capable of producing structures of comparable strength. Prior to delivery of the precast wall units 12, a layout crew sets wall lines. Using a relatively lightweight crane, wall units 12 are removed from the delivery truck and stacked over the wall bars 24, a bed of mortar 80 being laid down on the foundation first. Between the first course of wall units 12 and the foundation 22, structural shims are placed as needed, together with the modified spacer/tensioning brackets 62 having no lower alignment fins 72. In between each stacked wall unit 12, an installation crew places combination spacer/tensioning assemblies 14, spacer assemblies 16 and 17, extension assemblies 20, horizontal rebar 90, and/or tensioning assemblies 18 as needed. A bed of mortar 80 is also laid down. The wall units 12 are easily positioned atop one another because of the built-in alignment features of the various spacer assemblies 14, 16, and 17. As the wall 26 proceeds higher, the installation crew works atop a scissors lift, ladders, or scaffolding. Where necessary, external bracing 115 may be attached to the modified spacer assemblies 17. When stacking of the wall units 12 is complete, grout 84 is poured into the cavities 44 and the horizontal passages 86. Prior to pouring the grout 84, additional reinforcing steel may be placed into the vertically extending cavities 44, the structure of the wall units 12 allowing the resulting wall 26 to contain more reinforcing material than is possible with walls built using known CMU's. After the grout 84 has cured, any external bracing 115 and outer bracket halves 94 are removed and patches of mortar 80 applied.

Unlike cast-in-place concrete methods, the construction system 10 is a very "clean" system. The present invention also completely eliminates the need to create forms on site. The inherent stability of structures created with the construction system 10 eliminates as well the need for a welded superstructure. The construction system 10 of the present invention is intended to be widely used in the construction industry as a quick, precise, cost effective and strength equivalent alternative to cast-in-place concrete structural elements. For these reasons and numerous others as set forth herein, it is expected that the industrial applicability and commercial utility of the present invention will be extensive and long lasting.

What is claimed is:

1. A modular construction system comprising:

a plurality of block units, each said block unit being precast of concrete, each said block unit having a length, a width, a height, a top surface and a bottom surface, the length being substantially greater than the width, each said block unit further having end walls, a pair of side walls extending the length of each said block unit, and a plurality of cavity walls disposed between the pair of side walls and integral therewith, each side wall having a width and containing a reinforcement structure, each cavity wall having a height and a top surface, the cavity walls and the pair of side walls defining a plurality of cavities, said block units being arranged with the bottom surface of a first said block unit opposing the top surface of a second said block unit, the cavity walls of the arranged said block units defining a plurality of first passages extending the height of said block units; and spacer means for providing a joint space between the top and bottom surfaces of said block units for placement of bonding material.

2. The construction system of claim 1 wherein the reinforcement structure is at least one longitudinally disposed, prestressed reinforcement wire.

3. The construction system of claim 1 wherein at least one of the passages is filled with cementitious material.

4. The construction system of claim 1 further including a reinforcing bar extending from a base structure and into the cavities of one or more said block units.

5. The construction system of claim 4 wherein the reinforcing bar is threaded and further including a threaded extension bar and a threaded coupler, the coupler threadably engaging the reinforcing bar and the extension bar and creating an extended reinforcing bar thereby.

6. The construction system of claim 4 further including tensioning means.

7. The construction system of claim 6 wherein the reinforcing bar is threaded and wherein the spacer means and tensioning means are integral and include a bracket and a nut, the bracket having a length and a thickness, the length being sufficient to span the distance between the pair of side walls, the thickness providing the cementitious joint space, the bracket further having an aperture through which the reinforcing bar is received, the nut threadably engaging the reinforcing bar, torquing force being applied to the nut to tension the bracket onto the top surface of a first said block unit and thereby tension the first said block unit onto a second said block unit or the base structure.

8. The construction system of claim 7 wherein the bracket further includes alignment fins, the alignment fins insertably fitting in close relation between the pairs of side walls of said block units and aligning said block units thereby.

9. The construction system of claim 8 wherein the bracket has the feature of being aerodynamically shaped.

10. The construction system of claim 6 wherein the reinforcing bar is threaded and further including a reinforcing rod longitudinally disposed and lying on the top surface of the cavity walls of a first said block unit and wherein the tensioning means includes a bracket and a nut, the bracket having a notch into which the reinforcing rod is received, the bracket further having an aperture through which the reinforcing bar is received, the nut threadably engaging the reinforcing bar, torquing force being applied to the nut to tension the bracket onto the reinforcing rod and thereby tension the first said block unit onto a second said block unit or the base structure.

11. The construction system of claim 10 further including the cavity walls having notches in the top surfaces thereof for receiving the reinforcing rod in predetermined alignment.

12. The construction system of claim 1 further including a reinforcing rod longitudinally disposed and the cavity walls further having notches in the top surfaces thereof for receiving the reinforcing rod in predetermined alignment.

13. The construction system of claim 1 further including alignment means for aligning said block units.

14. The construction system of claim 13 wherein the alignment means and the spacer means are integral and include an inner bracket half and an outer bracket half removably joined together, the inner bracket half and the outer bracket half each having alignment fins and a spacer fin, the spacer fin providing the cementitious joint space, the side walls or the end walls of two said block units insertably fitting in close relation between the alignment fins and aligning said block units thereby.

15. The construction system of claim 14 wherein the outer bracket half further includes a brace fin for assisting in bracing and aligning said block units.

16. The construction system of claim 13 wherein the alignment means includes at least one of said side walls and said end walls having a notch, and further includes a fixture, the fixture being mateably received by the notch.

17. A wall construction system comprising:

a plurality of wall units formed of precast concrete, each said wall unit having a length, a width, a top surface and a bottom surface and a pair of vertically disposed, opposing side walls, the length being substantially greater than the width, each side wall containing at least one prestressed reinforcing wire, each said wall unit further having a plurality of vertically disposed cavity walls integral with the side walls, said wall units being vertically stacked to create a wall, said wall units having the feature of creating a plurality of vertically extending grout receiving passages; and spacer means for providing a joint space between the top and bottom surfaces of said block units for placement of bonding material.

18. A modular building block system comprising:

a plurality of block units, each said block unit being precast of cementitious material, each said block unit having a length, a width, a height, a top surface and a bottom surface, the length being substantially greater than the width, each said block unit further having end walls, a pair of side walls extending the length of each said block unit, and a plurality of cavity walls disposed between the pair of side walls and integral therewith, each side wall having a width and containing at least one pre-tensioned reinforcement wire to impart a prestressed character to each said block unit, each cavity wall having a height and a top surface, at least one cavity wall having a height that is less than the height of said block units, the cavity walls and the pair of side walls defining a plurality of cavities, said block units being arranged with the bottom surface of a first said block unit opposing the top surface of a second said block unit, the cavity walls of the arranged said block units defining a plurality of first passages extending the height of said block units and one or more second passages extending longitudinally between at least two cavities.

19. The building block system of claim 18 wherein at least one of the first and second passages is filled with cementitious material.

* * * * *